United States Patent [19]

Hetz

[11] 4,279,276

[45] Jul. 21, 1981

[54] LOOP PICKER AND METHOD OF MAKING SAME

[75] Inventor: G. Brian Hetz, Springfield, Mo.

[73] Assignee: Dayco Corporation, Dayton, Ohio

[21] Appl. No.: 79,124

[22] Filed: Sep. 26, 1979

[51] Int. Cl.[3] ..... D03D 49/36

[52] U.S. Cl. ..... 139/159

[58] Field of Search ..... 139/159, 160 R; 264/258

[56] References Cited

U.S. PATENT DOCUMENTS

| | | | |
|---|---|---|---|
| 2,032,734 | 3/1936 | Bacon | 139/159 |
| 2,172,921 | 9/1939 | Bacon | 139/159 |
| 2,275,728 | 3/1942 | Carter | 139/159 |
| 2,389,952 | 11/1945 | Brown | 139/160 |
| 3,133,847 | 5/1964 | Millington | 264/258 |
| 3,608,588 | 9/1971 | Brown | 139/159 |
| 4,130,142 | 12/1978 | Tell | 139/159 |

FOREIGN PATENT DOCUMENTS

| | | | |
|---|---|---|---|
| 352522 | 7/1931 | United Kingdom | 139/159 |
| 293073 | 1/1971 | U.S.S.R. | 139/159 |

*Primary Examiner*—Henry Jaudon

*Attorney, Agent, or Firm*—Charles E. Bricker

[57] ABSTRACT

A loop picker and method of making same are provided wherein such picker has a body provided with a picker stick receiving passage extending therethrough and a forward block, and the block and body are comprised of a single strip of laminated fabric consisting of a forward portion and a trailing portion with the trailing portion being disposed in wound relation and having an innermost turn which defines the major portion of the inside surface of the passage.

4 Claims, 10 Drawing Figures

LOOP PICKER AND METHOD OF MAKING SAME

BACKGROUND OF THE INVENTION

1. Field of the Invention

This invention relates to a so-called loom or loop picker employed in the weaving art.

2. Prior Art Statement

Many looms utilized in the weaving industry utilize a freely traveling shuttle to carry each weft thread transversely to warp threads to define a woven fabric and it is common practice to impart motion to such a shuttle using a so-called loop picker. Each loop picker generally is attached to the end of a picker stick and such stick is activated by the loom so as to allow the loop picker to absorb the impact of the oncoming shuttle and immediately thereafter to propel the shuttle with sufficient force to send same in an opposite direction.

In a weaving operation of this type there is repeated impact of the shuttle against each loop picker causing wear thereof. Accordingly, it is necessary to routinely replace each picker whereby it is desirable to keep the cost of each picker at a minimum without sacrificing its wear and impact absorbing characteristics.

Present loop pickers are generally comprised of a so-called forward block and a main body which has a picker stick receiving passage therethrough and various constructions have been proposed heretofore in an effort to improve the operating characteristics of such pickers. Examples of loop picker constructions are presented in the following United States patents:

(1) U.S. Pat. No. 4,130,142

(2) U.S. Pat. No. 2,389,952

(3) U.S. Pat. No. 2,172,921

It appears that the loop picker of item (1) has a forward block and a main body made of a plurality of pieces of fabric and uses a so-called triaxial fabric for improved wear.

It appears that the loop picker of item (2) has a picker stick receiving passage defined by the edges of a plurality of turns of material and requires so-called tubular and wedge-shaped components in order to maintain the structural integrity of the main body through which the picker stick is received.

It appears that the loop picker of item (3) has a forward block and a main body each consisting of a plurality of pieces of fabric.

SUMMARY

It is a feature of this invention to provide an economical loop picker yet which has the required wear and impact absorbing properties.

Another feature of this invention is to provide a loop picker of the character mentioned comprised of a single strip of laminated fabric.

Another feature of this invention is to provide a loop picker of the character mentioned in which the laminated fabric may be any fabric used in the art of making loop pickers.

Another feature of this invention is to provide a loop picker of the character mentioned in which the single strip of laminated fabric consists of a forward portion and a trailing portion and the trailing portion is disposed in wound relation and defines the body of the picker and has an innermost turn which defines the major portion of the inside surface of a picker stick receiving passage of such picker which extends through such body.

Another feature of this invention is to provide a loop picker of the character mentioned in which the forward portion of the fabric defines the forward block of the loop picker and the trailing portion defines the remainder of such loop picker.

Another feature of this invention is to provide a loop picker of the character mentioned in which the forward portion and trailing portion of the fabric are both disposed in wound relation.

Another feature of this invention is to provide an improved method of making a loop picker of the character mentioned.

Another feature of this invention is to provide an improved method of making a loop picker having a body with a picker stick receiving passage extending therethrough and a forward block and such method comprises the step of forming the block and body of a single strip of a laminated fabric which consists of a forward portion which defines the block and a trailing portion which defines the body and the forming step comprising winding the trailing portion about an innermost turn thereof to define the major portion of the inside surface of the passage.

Another feature of this invention is to provide a method of making a plurality of loop pickers from a single strip of comparatively wide fabric which is suitably formed in a configuration to define an elongate workpiece which is subsequently cut to define a plurality of uncured loop picker constructions and each construction is then cured in a mold device, cooled, and trimmed to define a loop picker in accordance with this invention.

Therefore, it is an object of this invention to provide an improved loop picker and method of making same having one or more of the novel features set forth above or hereinafter shown or described.

Other details, features, uses, objects, and advantages of this invention will become apparent from the embodiments thereof presented in the following specification, claims, and drawings.

BRIEF DESCRIPTION OF THE DRAWINGS

The accompanying drawings show present preferred embodiments of this invention, in which.

DESCRIPTION OF ILLUSTRATED EMBODIMENTS

Figure 4:
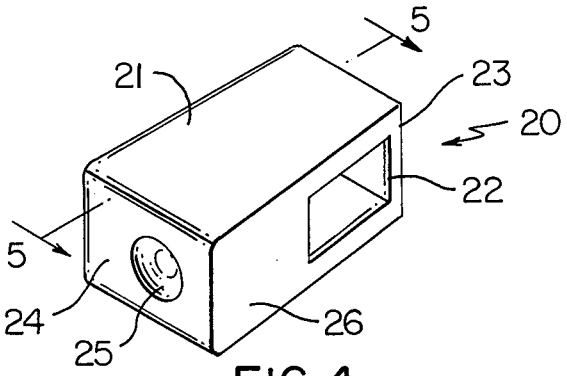
FIG. 4 is a perspective view of a typical completed loop picker after manufacture thereof employing the steps illustrated in FIGS. 1 and 3.
Figure 5:
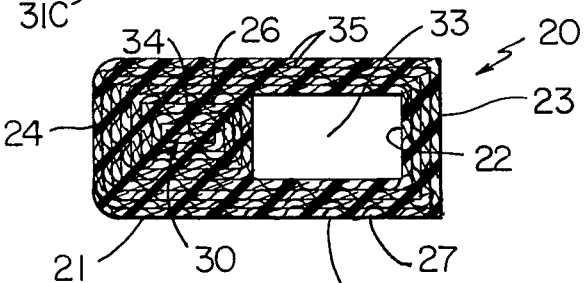
FIG. 5 is a cross-sectional view taken essentially on the line 5—5 of FIG. 4.

Reference is now made to FIGS. 4 and 5 of the drawings which illustrate one exemplary embodiment of a loom or loop picker of this invention which is designated generally by the reference numeral 20. The loop picker 20 has a main body 21 and has a picker stick receiving passage 22 extending through the body which is particularly adapted to receive a picker stick (not shown) through such passage for the purpose of supporting the picker on its associated loom apparatus and as is known in the art.

The exemplary picker 20 has a substantially planar rear face 23 and a substantially planar forward face 24 and the faces 23 and 24 are disposed in substantially parallel relation. The forward face 24 has a substantially frustoconcial recess 25 provided therein for the purpose of receiving therewithin the nose of an associated shuttle (not shown) during impact between the shuttle and picker 20.

The picker 20 has a forward block which is often popularly referred to as a face block 26 and the forward block 26 and body 21 are made of a single strip of laminated fabric 27. The fabric strip 27 consists of what may be considered a forward portion of such strip which is designated by the reference numeral 30 and is suitably formed to define the forward block 26 and a trailing portion 31 which basically defines the main body 21 of the picker 20 and such trailing portion 31 is disposed in wound relation and has an innermost turn thereof which defines the major portion of the inside surface of the passage 22. The passage 22 of this example is of rectangular outline and has a longitudinal axis 33 extending therethrough.

The forward portion 30 of the fabric 27 which defines the forward block 26 is disposed in wound relation essentially about another axis 34 which is parallel to the longitudinal axis 33 of the passage 22. Thus, the forward portion 30 defining the block 26 and the trailing portion of the fabric 27 defining the body 21 of the picker are both disposed in wound relation.

As indicated earlier the fabric 27 is a single piece of fabric and is made of various cooperating filaments and/or yarns which may be made of suitable non-metallic material. The fabric 27 has a coating of polymeric material on at least one surface thereof and in this example of the invention the fabric 27 has a coating of polymeric material on both of its opposed surfaces. For ease of drawing presentation each coating is indicated by the same line which defines an associated outside surface of the fabric and is designated by a single reference numeral 35 in each instance. The coatings 35 of polymeric material serve to bond adjoining portions of the strip in a manner which will be apparent from the following description. The coating 35 may be any suitable polymeric material employed in the art for this purpose and in the example of FIGS. 4 and 5 such polymeric coating 35 is in the form of a rubber compound and indicated by typical rubber cross-hatching in FIG. 5.

Figure 1:
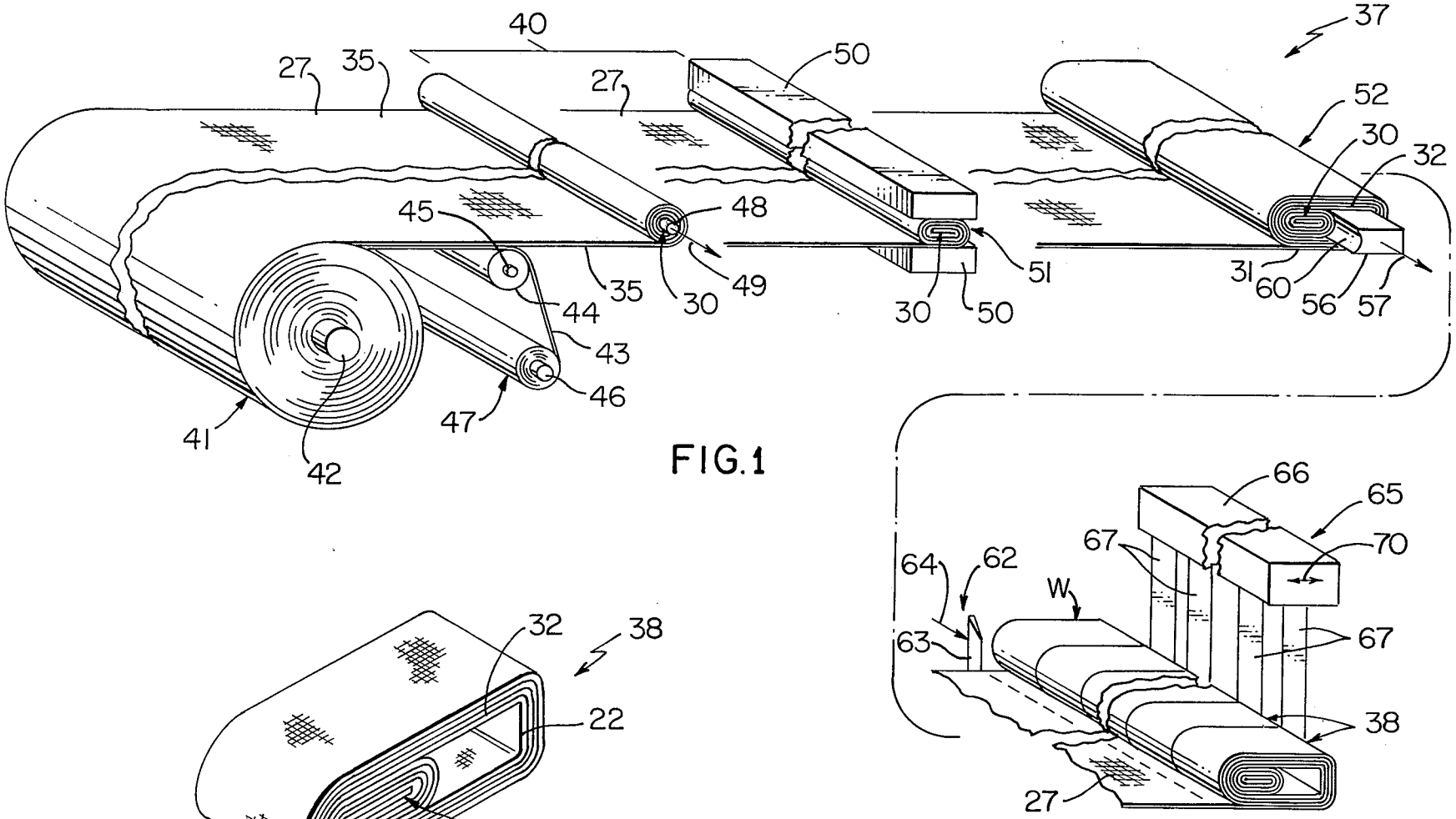
FIG. 1 is a perspective view with parts in elevation and parts broken away illustrating a series of steps of the method and associated apparatus employed to define the loop picker of this invention.
Figure 2:
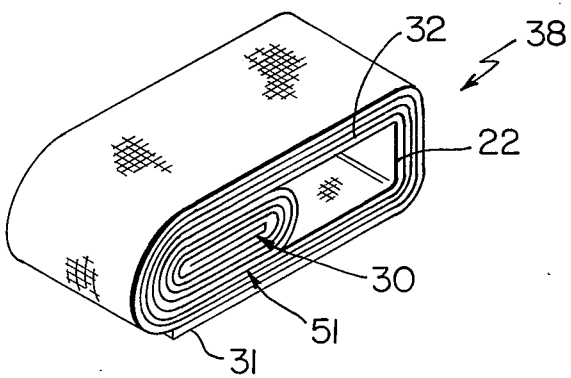
FIG. 2 is a perspective view of a typical uncured loop picker construction at the completion of the cutting step illustrated in FIG. 1.

Having presented an overall description of the exemplary loop picker 20, the detailed description will now proceed with the method of this invention and associated apparatus which may be employed to make the loop picker 20 and such apparatus and method are shown schematically in part in FIG. 1 and designated generally by the reference numeral 37. The method 37 of FIG. 1 shows steps used in forming a plurality of loop picker constructions each designated by the reference numeral 38 and a typical construction 38 is shown in FIG. 2. Each construction 38 of FIG. 2 is finally formed, cured, cooled, and dressed (by removing flashing therefrom) as will be subsequently described to define an associated picker 20.

In carrying out the method 37 the previously mentioned fabric 27 is provided so as to define a supply roll 41 thereof and such supply roll is suitably supported on a shaft 42 for unwinding rotation. The fabric 27 has the coatings 35 of polymeric material, i.e., rubber, on its opposed surfaces and such coatings at this stage are uncured rubber coatings which, for ease of presentation, are also designated by the reference numeral 35. To prevent the uncured rubber from causing adjoining turns of coated fabric from adhering to each other a release tape or sheet 43 is provided against one surface of the fabric 27 and is coextensive in width therewith. Prior to introducing the fabric 27 into a forward block forming station 40 where the basic construction of the forward block 26 is formed the release sheet 43 is removed. The release sheet 43 is removed by moving same around a turn roll 44 which is rotatably supported on a shaft 45; and, the release sheet 43 is wound on a mandrel or core 46 to define a supply roll 47 of such release sheet. The release sheet 43 may be unwound from its roll and reused.

At the forming station 40 the fabric 27 is wound on an elongate rod 48 or member which in this example is shown as having a right circular cylindrical configuration and after the required amount of fabric 27 (in essence, defining the forward portion 30 of each loop picker construction 38 and thus loop picker 20) is wound on such rod the rod 48 is withdrawn. The rod 48 is withdrawn utilizing a suitable withdrawing apparatus 49 which is designated schematically by an arrow 49. To facilitate the withdrawal of the rod 48 the rod may be coated with a suitable antifriction material or the rod may be made of a material which will not readily adhere to the coating 35 of polymeric material on the inner turn of the fabric 27.

Once the rod 48 is removed the forward portion 30 of the coated fabric 27 is further processed in the forming station 40 where the substantially right circular cylindrical forward portion is compressed between a pair of cooperating compressing members each designated by the same reference numeral 50. The members 50 compress the forward portion 30 of fabric 27 and hence the block 26 to define a roughly oval peripheral outline therein as shown at 51 in FIGS. 1 and 2.

The oval block 26 is then further processed at what will be referred to as a body forming station 52. At station 52 what amounts to a trailing portion 31 of fabric 27 is wound about the innermost turn 32 thereof and such innermost turn defines the major portion of the inside surface of the passge 22 in each construction 38 and each completed picker 20, and as will be readily apparent from the following description.

To facilitate the winding of the trailing portion 31 of fabric sheet 27 about the inner turn 32, a body support member 56 is employed. The member has an outline and cross-sectional area which roughly approximates the outline and cross-sectional area of the passage 22 as viewed looking into the end of such passage. Once the trailing end portion 31 is wound to define an elongate workpiece W the support member 56 is removed employing a suitable withdrawing apparatus indicated schematically by an arrow 57.

The support member 56 of this example has a roughly rectangular cross-sectional outline one side 60 of which has an arcuate configuration which, in this example, roughly approximates the arcuate outer surface of the forward block 26 at this stage of manufacture. However, it will be appreciated that the support member 56 may be of rectangular cross-sectional outline and need not necessarily have the arcuate surface 60. The support member 56 is preferably provided with a suitable antifriction coating on the outside surface thereof to facilitate its withdrawal.

Once a particular length of fabric 27 comprised of the forward portion 30 and trailing portion 31 has been suitably wound to define the workpiece W and the support member 56 removed, the workpiece W is then cut at a web cutting station 62. At the station 62 a knife or suitable cutting device shown schematically as a blade 63 is actuated by a suitable actuator 64 and cuts transversely across the full width of the fabric web 27 to sever the elongate workpiece W from the remainder of the web of fabric. In this disclosure of the invention, it will be appreciated that the previously referred to leading end or forward portion 30 of fabric 27 is merely the first portion unwound from the supply roll 41 and the trailing portion 31 is defined at the web cutting station 62 once the fabric 27 is cut away from its supply roll 41.

The elongate workpiece W is then moved to a workpiece cutting station 65 where a cutting apparatus 66 is employed to cut such workpiece and define a plurality of loop picker constructions 38 and a typical construction is shown in perspective view in FIG. 2. The cutting apparatus 66 comprises a plurality of knives each designated by the same reference numeral 67 and such knives are used to cut the workpiece W in a simultaneous manner to define a plurality of loop picker constructions 38. The knives 67 are suitably mounted in the apparatus 66 and may be of the vertically oscillating type such that upon moving the apparatus and knives against the workpiece W a simultaneous cutting action is provided. The apparatus 66 may be moved toward and away from the workpiece W by a moving device which is shown schematically as a double arrow 70.

From the above description, it is apparent that a single web or strip of fabric 27 having a coating 35 of uncured polymeric material on opposed surfaces thereof may have its forward portion suitably wound and formed at a forming station 40 to define a forward block construction 26. The trailing portion 31 of the fabric strip is then wound at a forming station 52 whereupon the resulting construction defines an elongate workpiece W which is moved to a web cutting station 62 and cut away from the supply roll 41 while defining a severed end of fabric which becomes the forward portion 30 of a new workpiece W upon being wrapped about a rod 48 and the above-described operation repeated. The workpiece W is then moved to the cutting station 65 to define a plurality of loop picker constructions 38.

Figure 3:
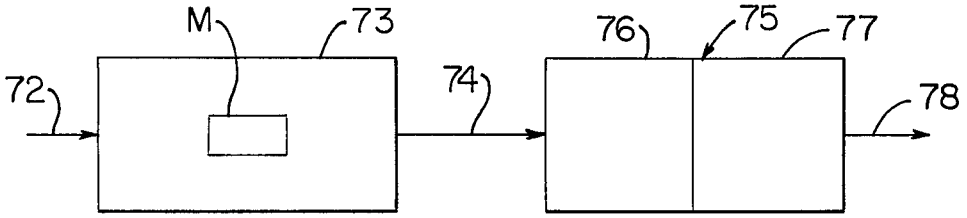
FIG. 3 is a schematic view showing further method steps employed in processing the picker construction of FIG. 2.

Each loop picker construction 38 is transferred as indicated by arrow 72 in FIG. 3 to a curing apparatus 73. However, prior to curing each construction 38 in the apparatus 73 the construction 38 is disposed in a mold device of a type which is known in the art. A representative mold device is shown by a rectangular block M within the apparatus 73. The mold device M defines the basic overall configuration of the loop picker 20 and as typically shown in FIG. 4. In particular, during the curing step in apparatus 73, the walls of the mold device M basically define all exposed surfaces of the loop picker 20 while suitable projections in the mold device define the passage 22 and recess 25. A plurality of mold devices M and their constructions 38 are cured in a simultaneous manner in the apparatus 73 although only one device M is shown in such apparatus in FIG. 3. During molding, and as is known in the art, the polymeric coating 35 on each side of the fabric 27 provides a tenacious bond between adjoining layers and also results in polymeric flashing material (not shown) at the corners of the loop picker 20, around the recess 25, around the opposed edges of the passage 22.

Each cured loop picker 20 is then moved as indicated by the arrow 74 to a cooling and trimming station 75 where a suitable cooling apparatus 76 is used for cooling purposes and a commercially available trimming apparatus 77 used for trimming purposes to define the loop picker 20 of FIG. 4. Each cooled and trimmed loop picker 20 is then moved as indicated by the arrow 78 to a shipping station for packaging and shipment to a customer.

Figure 6:
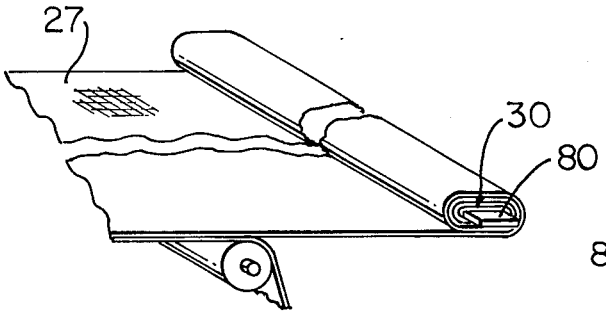
FIG. 6 is a perspective view with parts broken away illustrating a modification of the method steps used in forming the forward block of the picker of this invention.

Instead of winding the forward portion 30 of the coated fabric 27 on the right circular cylindrical rod 48 as shown in FIG. 1, such forward portion may be wound on a blade 80, shown in FIG. 6 as having an exaggerated thickness. The blade 80 may be made of a rigid material such as thin spring steel, or the like; and, once the blade is removed the forward portion 30 is basically of the configuration shown in FIG. 2. The use of a blade 80 for winding portion 30 eliminates the need for the compressing action provided by the compressing members 50. The blade 80 may be provided with a suitable antifriction material on its outside surface or may be made of a rigid high strength material having inherent antifriction properties to facilitate its withdrawal.

Figure 9:
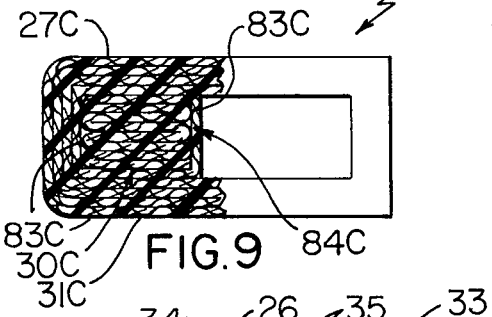
FIG. 9 is a view similar to FIG. 8 of another exemplary embodiment of the loop picker of this invention.
Figure 7:
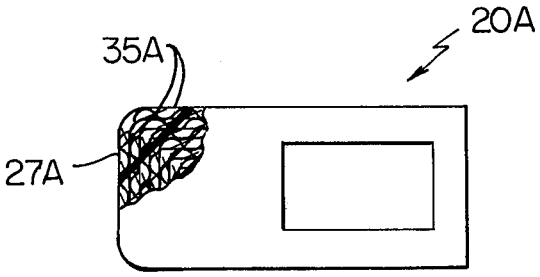
FIG. 7 is a primarily plan view of another exemplary embodiment of the picker of this invention with a portion thereof shown in cross section.
Figure 8:
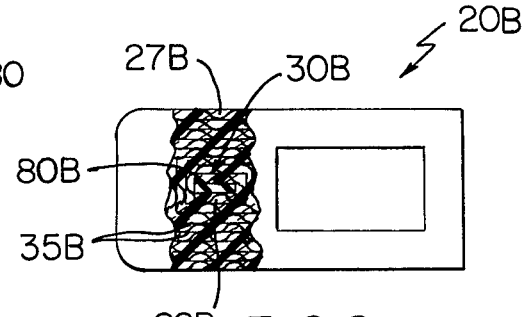
FIG. 8 is a view similar to FIG. 7 of another exemplary embodiment of the loop picker of this invention.

Other exemplary embodiments of the loop picker of this invention are illustrated in FIGS. 7, 8, and 9 of the drawings. The loop pickers illustrated in FIGS. 7, 8 and 9 are very similar to the loop picker 20; therefore, such loop pickers will be designated by the reference numerals 20A, 20B, and 20C and representative parts of the loop pickers which are similar to corresponding parts of the loop picker 20 will be designated in the drawings by the same reference numeral as in the loop picker 20 (whether or not such representative parts are mentioned in the specification) followed by the associated letter designation A, B, or C and not described again in detail.

The loop picker 20A of FIG. 7 is comprised of fabric 27A which has a coating 35A on opposed surfaces which instead of being a rubber coating consists of a polymeric material in the form of a synthetic plastic. Accordingly, it will be seen that the cross-hatching through the fabric material is illustrated as a plastic cross-hatching; and, it will be appreciated that during curing of each picker construction the curing temperature, time, etc. are compatible with the plastic employed in the coating 35A.

The loop picker 20B of FIG. 8 is formed utilizing a blade member or blade 80B similar to the blace 80 illustrated in FIG. 6. However, the blade 80B is not withdrawn, is cut in position, and defines a flat core which is also designated 80B of its loop picker 20B. The core 80B is disposed centrally within the forward portion 30B of its fabric strip 27B. The forward portion 30B has an innermost turn 82B disposed against the core member 80B while being tenaciously bonded thereto. The core member 80B is wound in position, as mentioned above, in a similar manner as described in connection with FIG. 6 and the use of a flat member eliminates the need to compress the wound forward portion between a pair of compressing members 50.

The core member 80B is shown by cross-hatching as being a rubber member and it will be appreciated that such member is compatible with the rubber coating 35B provided on the fabric 27B of the loop picker 20B. Upon curing the loop picker construction in the curing apparatus 73 a tenacious bond is provided between the core member 80B and the innermost turn 82B of the forward portion 30B.

Figure 10:
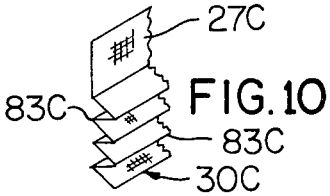
FIG. 10 is a view illustrating a modification of the method steps used in forming the forward block of the picker of FIG. 9.

The loop picker 20C of FIG. 9 has a forward portion 30C of the fabric 27C comprised of a plurality of folds each designated by the same reference numeral 83C of substantially equal size and folded in opposite directions. The folding is achieved essentially as shown at 84C (FIG. 9) and in FIG. 10 to define the forward portion 30C as a pleated forward portion. The folds are arranged so that they are alternately disposed in the forward and rear segments of the block as clearly shown in FIG. 9. The trailing portion 31C of the loop picker 20C is then wound around the pleated forward portion in a similar manner as described for the other embodiments of the loop picker described above.

The loop pickers 20B and 20C are shown by cross-hatching to indicate that the fabric layers are coated with rubber; however, such pickers may be made so that their fabrics are coated with polymeric material in the form of a synthetic plastic in a similar manner as the loop picker 20A.

The fabric 27, 27A, 27B, and 27C provided in making each of the various loop pickers may be any suitable fabric known in the art. In particular such fabric may be woven fabric, non-woven fabric, knitted fabric, triaxial fabric, and the like. Preferably, such fabric is made of non-metallic material with component portions thereof being made of natural, or synthetic yarns or filaments or combinations of natural and synthetic components.

In FIG. 1 of this disclosure of the invention the forming stations 40 and 52 and the cutting stations 62 and 65 have been shown at spaced positions in a flow path; however, it will be appreciated that this has been achieved for ease of presentation and it is to be understood that each of these stations is preferably provided in close proximity to the supply roll 41. For example, each of these stations may be spaced horizontally a comparatively small distance from the supply roll 41 with the stations being vertically spaced above each other whereby all operations shown in FIG. 1 are performed in close proximity to the supply roll. In this manner once the cutting is completed at cutting station 62 the fabric material is essentially closely adjacent to the supply roll 41 so that another workpiece W may be commenced and completed.

It will also be appreciated that instead of providing a large supply roll 41 with sufficient fabric thereon to define a plurality of workpieces W, such supply roll 41 may be provided with only the required amount of material necessary to form a single workpiece W. With this type of arrangement a workpiece W may be defined at stations which may be horizontally displaced, vertically displaced, or arranged in any desired manner.

The coating, such as the coating 35 provided on the fabric 27, for example, may be provided employing any suitable technique known in the art. Accordingly, such coating may be provided by what is popularly referred to as frictioning, skim coating, knife coating, or the like.

In this disclosure of the invention each loop picker has been shown and described as having substantially planar rear and front faces (such as faces 23 and 24 of picker 20) as well as substantially planar sides. However, it will be appreciated that such faces and sides may have any configuration known in the art.

While present exemplary embodiments of this invention, and methods of practicing the same, have been illustrated and described, it will be recognized that this invention may be otherwise variously embodied and practiced within the scope of the following claims.

What is claimed is:

1. In a loop picker having a forward block and a body with a picker stick receiving passage extending therethrough, the improvement in which said block and said body are constructed of a single, continuous strip of laminated fabric having a coating of a polymeric material on at least one surface therof, said polymeric material serving to bond adjoining portions of said strip, said single strip having a pleated forward portion and a trailing portion, wherein said pleated portion defines said block and consists of a plurality of alternatingly disposed folds of substantially equal size, said folds being disposed in the forward and rear segments of said block, and wherein said trailing portion is disposed in wound relation to define said body, said trailing portion having an innermost turn which defines the major portion of the inside surface of said passage.

2. A loop picker as set forth in claim 1 in which said polymeric material is a rubber compound.

3. A loop picker as set forth in claim 1 in which said polymeric material is a synthetic plastic material.

4. A loop picker as set forth in claim 1 in which said fabric comprises a coating of polymeric material on each of its opposed main surfaces, said polymeric material serving to bond adjoining portions of said strip.

* * * * *